US011541417B2

(12) United States Patent
Yang et al.

(10) Patent No.: US 11,541,417 B2
(45) Date of Patent: Jan. 3, 2023

(54) ELECTRIC GLUE GUN

(71) Applicant: Zhejiang Prulde Electric Appliance Co., Ltd., Zhejiang (CN)

(72) Inventors: Weiming Yang, Zhejiang (CN); Ting Han, Zhejiang (CN)

(73) Assignee: Zhejiang Prulde Electric Appliance Co., Ltd., Zhejiang (CN)

( * ) Notice: Subject to any disclaimer, the term of this patent is extended or adjusted under 35 U.S.C. 154(b) by 251 days.

(21) Appl. No.: 17/031,919

(22) Filed: Sep. 25, 2020

(65) Prior Publication Data

US 2021/0094062 A1 Apr. 1, 2021

(30) Foreign Application Priority Data

Sep. 30, 2019 (CN) ..... 201910941732.3

(51) Int. Cl.
*B05C 17/01* (2006.01)

(52) U.S. Cl.
CPC ..... *B05C 17/0103* (2013.01); *B05C 17/014* (2013.01); *B05C 17/0116* (2013.01)

(58) Field of Classification Search
CPC ..... B05C 17/0003; B05C 17/0116
See application file for complete search history.

(56) References Cited

U.S. PATENT DOCUMENTS

2008/0308580 A1* 12/2008 Gaydos ..... A61M 15/0065 222/333
2009/0101673 A1* 4/2009 Alioto ..... B05C 17/0103 222/113
2012/0118913 A1* 5/2012 Naughton ..... B05C 17/0103 222/137
2013/0055834 A1 3/2013 Naughton et al.
2015/0157429 A1* 6/2015 Gramann ..... B05C 17/0103 222/326
2017/0189930 A1* 7/2017 Turner ..... B05C 17/00553
2017/0259485 A1 9/2017 Strobel-Schmidt et al.
2018/0078967 A1 3/2018 Turner et al.

OTHER PUBLICATIONS

"Search Report of Europe Counterpart Application", dated Feb. 24, 2021, pp. 1-4.

* cited by examiner

*Primary Examiner* — Jeremy Carroll
(74) *Attorney, Agent, or Firm* — JCIP Global Inc.

(57) ABSTRACT

An electric glue gun includes a housing, a glue tube holder arranged at a front end of the housing, and a push rod disposed on the housing and moveable forward and rearward relative to the glue tube holder. A control board, a main switch, an electric motor and a transmission mechanism are provided inside the housing. The main switch is electrically connected to the control board for controlling power on/off, the electric motor is electrically connected to the control board to drive the push rod to move forward or rearward via the transmission mechanism. The electric glue gun further includes a sensor switch for facilitating control of a forward/rearward movement stroke of the push rod, and the sensor switch is electrically connected to the control board, such that the control board determines whether the push rod is moved to a limit position based on information feedback from the sensor switch.

12 Claims, 5 Drawing Sheets

ELECTRIC GLUE GUN

CROSS-REFERENCE TO RELATED APPLICATION

This application claims the priority benefit of China application serial no. 201910941732.3, filed on Sep. 30, 2019. The entirety of the above-mentioned patent application is hereby incorporated by reference herein and made a part of this specification.

BACKGROUND

Technical Field

The present disclosure relates to the field of electric tools, and more particularly relates to an electric glue gun.

Description of Related Art

An electric glue gun is an electric tool which leverages the power supplied by an electric motor to drive, via a transmission device, a push rod to extrude a glue tube, causing the glue to flow out of the tip of the glue tube, thereby implementing a filling function. Compared with manual glue guns, electric glue guns offer a higher efficiency and a more uniform glue output and are thus applied in a wide array.

After the glue inside the glue tube is completely squeezed out, a continued forward movement and extrusion of the push rod driven by the electric motor would cause an irreparable damage to the gun. In a no-load state, an excessive forward movement driven by the electric motor would also damage the gun. After the push rod moves rearward to reset, if the stroke of rearward movement exceeds a maximum stroke, it would also cause damages to the gun body. To address the above deficiencies, existing electric glue guns usually adopt a solution of manually stopping the gun based on the glue output conditions or reset conditions during use, which is highly demanding on an operator's experience and is prone to maloperation, thereby easily causing damages to the gun body.

SUMMARY

An objective of the present disclosure is to provide an electric glue gun so as to effectively prevent potential damages to the gun body due to incidental excessive forward movement or rearward movement of the push rod therein, thereby overcoming the drawbacks and defects in the prior art.

To achieve the objective above, an electric glue gun provided by the present disclosure comprises a housing, a glue tube holder arranged at a front end of the housing, and a push rod disposed on the housing and moveable forward and rearward relative to the glue tube holder. A control board, a main switch, an electric motor and a transmission mechanism are provided inside the housing. The main switch is electrically connected to the control board for controlling power on/off, and the electric motor is electrically connected to the control board to drive the push rod to move forward or rearward via the transmission mechanism. The electric glue gun further comprises a sensor switch for facilitating control of a forward/rearward movement stroke of the push rod. The sensor switch is electrically connected to the control board, such that the control board determines whether the push rod is moved to a limit position based on information feedback from the sensor switch.

Preferably, the transmission mechanism comprises a transmission gear, and the sensor switch comprises a first sensor switch corresponding to teeth on the transmission gear for detecting the rearward movement stroke of the push rod.

Preferably, the first sensor switch is an optoelectronic switch, the optoelectronic switch includes an emitting end and a receiving end, and the emitting end and the receiving end are respectively arranged at two axially opposite sides of the transmission gear and disposed in mutual correspondence.

Preferably, the transmission mechanism comprises a gear box, the transmission gear is rotatably disposed inside the gear box, the first sensor switch is provided on the gear box, and the gear box is formed with a through-hole corresponding to the first sensor switch.

Preferably, the transmission mechanism comprises a transmission shaft and an output gear which are provided in the gear box, the output gear and the transmission gear are both sleeved on the transmission shaft, transmission teeth engaged with the output gear are provided on the push rod; and/or, a support portion is provided at a front end of the gear box, a support hole is provided on the support portion, a support sleeve is provided at the support hole, and the push rod is disposed to penetrate through the support sleeve.

Preferably, a sensing element is provided at a rear end of the push rod, and the sensor switch comprises a second sensor switch corresponding to the sensing element for feeding back the forward movement stroke of the push rod.

Preferably, two second sensor switches are spaced apart from each other in a front-rear direction. In an operating state, the push rod is moved forward to a first limit position corresponding to a rear one of the second sensor switches. In a non-operating state, the push rod is moved forward to a second limit position corresponding to a front one of the second sensor switches.

Preferably, the sensing element is a magnet, and the second sensor switch is a magnetic sensor switch.

Preferably, the sensing element is disposed at a top side of the rear end of the push rod and the second sensor switch is provided above the sensing element; and/or a snap groove matched with the second sensor switch is provided on an inner wall of the housing, and the second sensor switch is disposed inside the housing by fitting with the snap groove.

Preferably, a trigger corresponding to the main switch is provided on the housing. The main switch is turned on when the trigger is pressed, and the main switch is turned off when the trigger is released; and/or, a push block is provided at a front end of the push rod.

With the above technical solutions, the present disclosure offers the following advantages.

1. The electric glue gun provided by the present disclosure offers an improved structure. The electric glue gun is additionally provided with a sensor switch, such that the control board can determine whether the push rod is moved forward to a limit position or is moved rearward to another limit position based on the information feedback from the sensor switch, so as to timely cut off the current in the electric motor or supply power reversely to the electric motor, which may avoid damages to the gun body due to excessive forward movement or excessive rearward movement of the push rod, thereby effectively guaranteeing the integrity and stability of the whole structure.

2. A first sensor switch is additionally provided within the housing. The first sensor switch can detect an operating condition of the transmission mechanism and feed back to the control board, such that the control board determines, based on the information fed back from the first sensor switch, whether the push rod is moved rearward as well as the rearward movement distance, which avoids damages to the push block at the front end of the push rod due to excessive rearward movement of the push rod, thereby effectively guaranteeing the integrity and stability of the whole structure and facilitating enhancement of use stability of the gun body. Specifically, the first sensor switch corresponds to the teeth on the transmission gear, such that the arc length traversed by rotation of the transmission gear may be derived by detecting the number of teeth traversed thereby, and in this way the rearward movement stroke of the push rod may be derived from the arc length. As such, an object to be detected by the first sensor switch can be reasonably set so as to satisfy detection requirements on accurately feeding back the rearward movement stroke of the push rod.

3. The first sensor switch preferably employs an optoelectronic switch, the emitting end and the receiving end of which are respectively disposed at two axially opposite sides of the transmission gear and arranged in mutual correspondence. When the transmission gear rotates till the teeth are located between the emitting end and the receiving end, the optical signals emitted by the emitting end are blocked by the teeth such that the receiving end cannot receive them. Therefore, the control board may derive the specific rearward movement stroke of the push rod based on the number of times of the failure of receiving the signals fed back by the optoelectronic switch.

4. The first sensor switch is provided on the gear box. By reasonably setting the specific mount structure of the first sensor switch to facilitate assembly, the first sensor switch may effectively avoid obstruction to the transmission mechanism while satisfying the detection requirements. By setting a through-hole corresponding to the first sensor switch on the gearbox, the first sensor switch can smoothly correspond to the gear teeth on the transmission gear.

5. Driven by the electric motor, the transmission mechanism drives, via the toothed engagement between the output gear and the push rod, the push rod to move forward or rearward, which facilitates guaranteeing the stability of forward or rearward movement of the push rod, and also facilitates guaranteeing that the squeezing force generated by forward movement of the push rod can satisfy user requirements. The push rod is arranged to penetrate through a support sleeve. The support sleeve plays a certain limit role to the push rod, which facilitates enhancement of the stability of rearward and forward movement of the push rod.

6. A sensing element is additionally provided on the push rod, and a second sensor switch is additionally provided inside the housing. When the push rod moves forward till the sensing element corresponds to the second sensor switch, the forward movement of the push rod is in position. Then, the control board may promptly supply power reversely to the electric motor based on the information feedback from the second sensor switch to cause the electric motor to rotate reversely and drive the push rod to move rearward. With the cooperation between the sensing element and the second sensor switch, the limit position for forward movement of the push rod can be controlled effectively and reasonably, thereby avoiding damages to the gun body due to excessive forward movement of the push rod.

7. Dependent on whether a glue tube is installed on the glue tube holder, two second sensor switches are spaced apart from each other in a front-rear position. By reasonably setting the specific number of the second sensing switches, they may better satisfy use requirements on detecting whether the push rod is moved forward in position.

When the gun body is in an operating state, i.e., the glue tube is installed on the glue tube holder, as the glue tube itself has a certain thickness in the front-rear direction, the push rod is moved forward till the sensing element corresponds to the rear one of the second sensor switches. At this point, the push rod reaches the first limit position, thereby avoiding continued forward movement of the push rod. Otherwise, the pressing force of the front end of the push rod would damage the glue tube holder.

If the glue tube holder is not installed with the glue tube, since there is no block by the glue tube, the forward movement stroke of the push rod will increase a little. When the push rod is moved, due to reasons such as manual operations, forward till the sensing element corresponds to the front one of the second sensor switches, the push rod reaches the second limit position. At this point, if the main switch is turned on, the control board supplies power reversely to the electric motor, and the electric motor then rotates reversely to drive the push rod to move rearward, thereby avoiding the push rod from continued forward movement. Otherwise, the pressing force of the rear end of the push rod would damage the housing.

8. The sensing element preferably adopts magnet, and correspondingly, the second sensor switch preferably adopts a magnetic sensor switch. By reasonably setting the specific structures of the sensing element and the second sensor switch, the magnetic sensor switch feeds back a signal to the control board when sensing the magnet. As such, the control board promptly instructs the electric motor to rotate reversely to drive the push rod to move rearward, thereby avoiding the push rod from continued forward movement. Otherwise, the pressing force of the handle at the rear end of the push rod would damage the gun body.

9. The sensing element is disposed at the top side of the push rod, and the second sensor switch is disposed above the push rod. By reasonably setting the specific disposition positions of the sensing element and the second sensor switch, they can better satisfy detection requirements. A snap groove is provided inside the housing. The second sensor switch is disposed in the housing by fitting with the snap groove. By reasonably setting the specific mount structure of the second sensor switch, it becomes easily assembled, and the stability of the second sensor switch can be effectively guaranteed.

DESCRIPTION OF THE EMBODIMENTS

Hereinafter, the present disclosure will be described in further detail through preferred embodiments with reference to the accompanying drawings. It needs to be understood that the oriental or positional relationships indicated by the terms "upper," "lower," "left," "right," "longitudinal," "transverse," "inner," "outer," "vertical," "horizontal," "top," "bottom," etc. are oriental and positional relationships only based on the drawings, which are intended only for facilitating or simplifying description of the present disclosure, not for indicating or implying that the devices/elements have to possess those specific orientations or have to be configured and operated with those specific orientations. Therefore, they should not be understood as limitations to the present disclosure.

Embodiment 1

Figure 1:
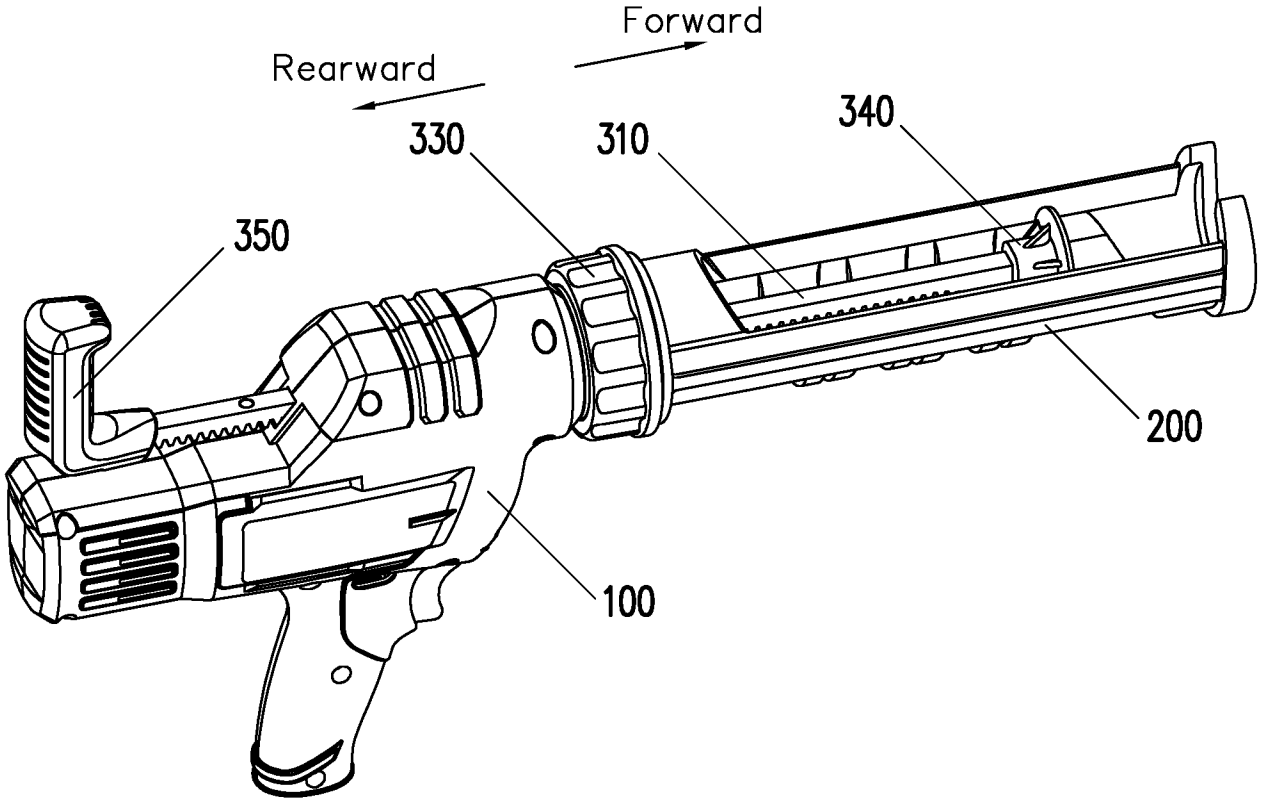
FIG. 1 shows an overall structural schematic diagram of an electric glue gun according to Embodiment 1 of the present disclosure.
Figure 2:
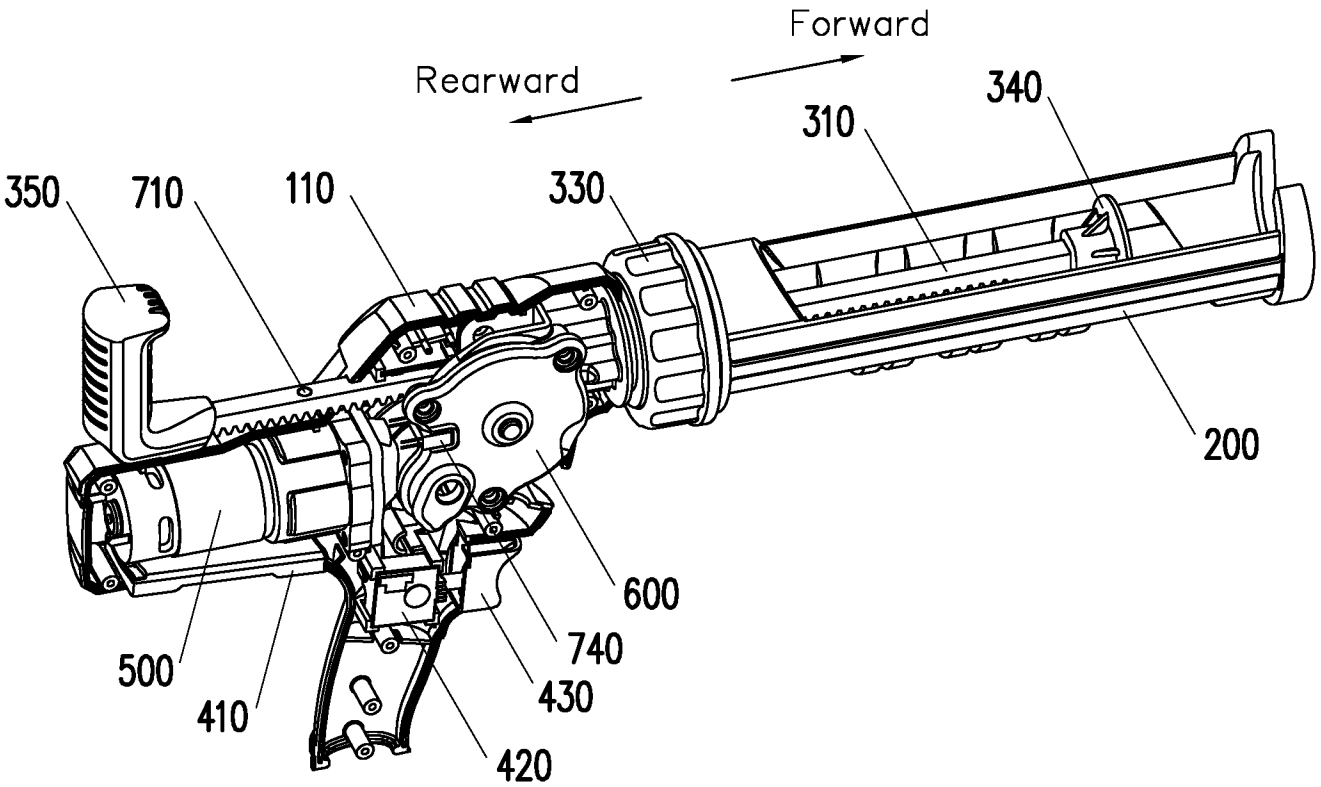
FIG. 2 shows a partially structural schematic diagram of the electric glue gun according to Embodiment 1 of the present disclosure.
Figure 3:
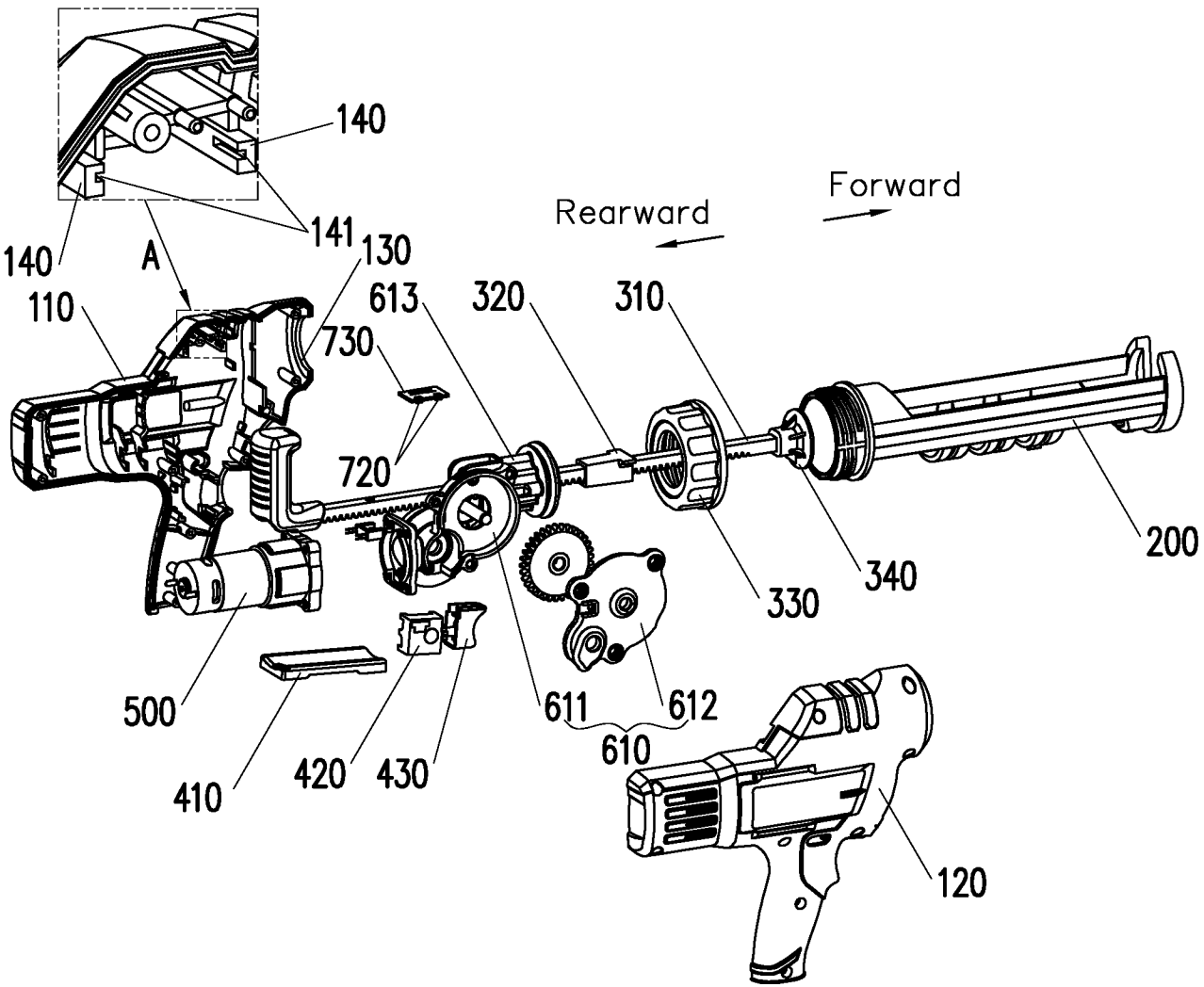
FIG. 3 shows an explosive schematic diagram of the electric glue gun according to Embodiment 1 of the present disclosure.
Figure 4:
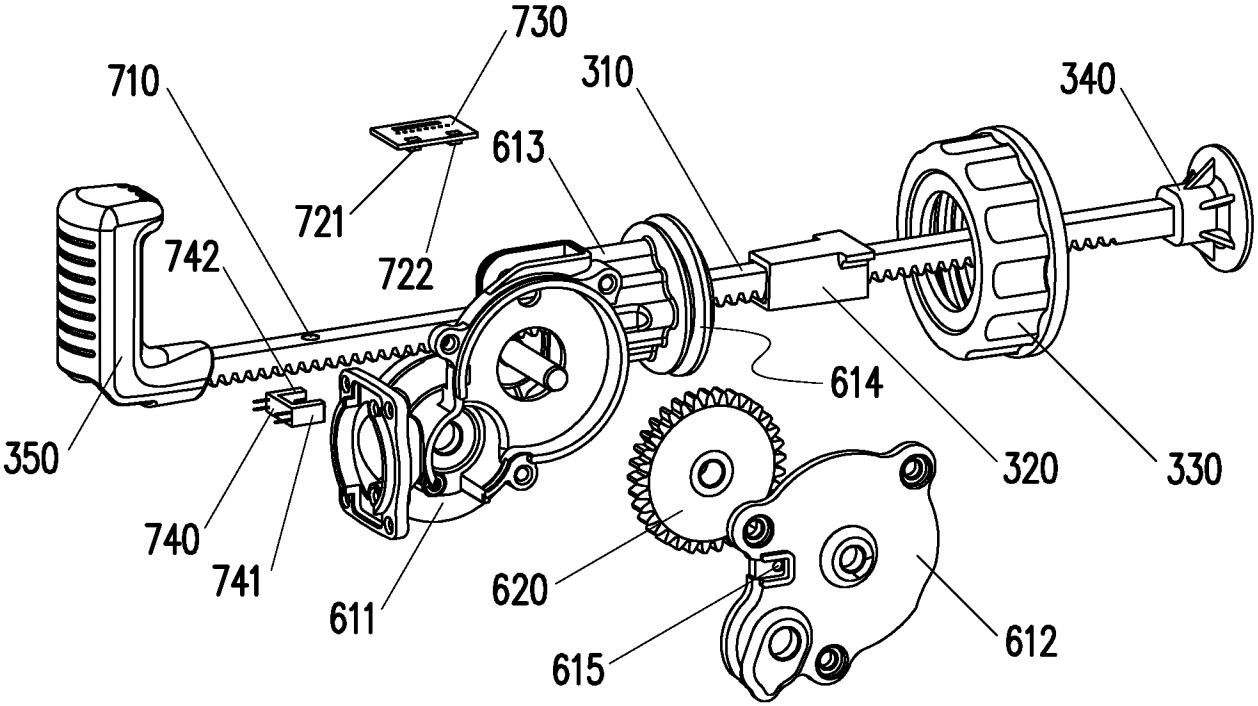
FIG. 4 shows a partially explosive view of the electric glue gun according to Embodiment 1 of the present disclosure.
Figure 5:
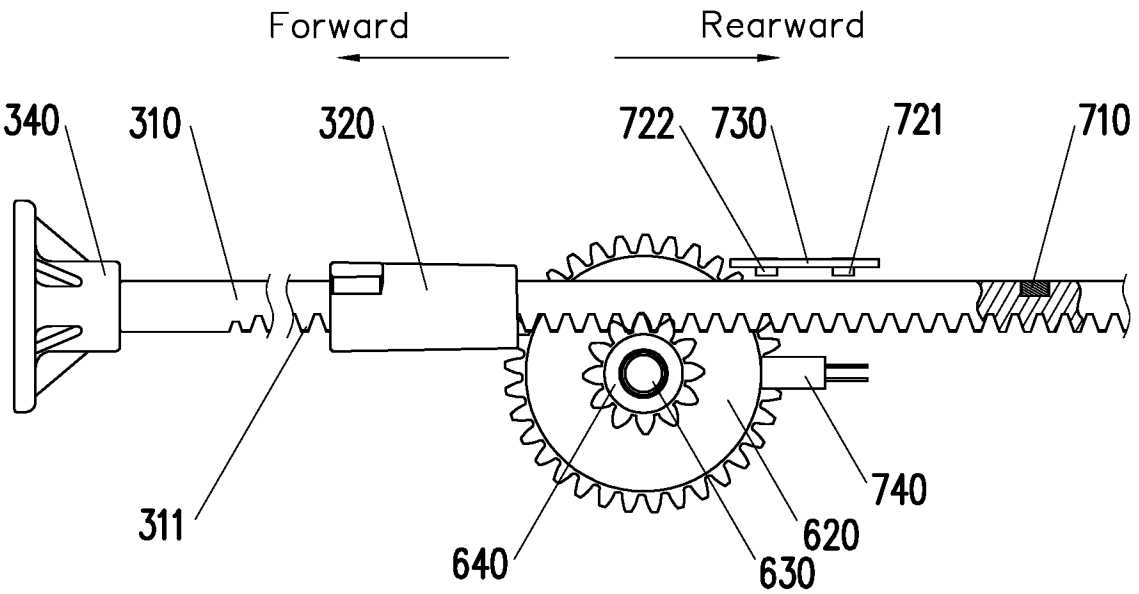
FIG. 5 shows a schematic diagram of a partial structure of the electric glue gun according to Embodiment 1 of the present disclosure.

As shown in FIG. 1, the electric glue gun provided in Embodiment 1 comprises a housing 100, a glue tube holder 200 arranged at the front end of the housing 100, and a push rod 310 disposed on the housing 100 and moveable forward or rearward relative to the glue tube holder 200. A control board 410, a main switch 420, an electric motor 500, and a transmission mechanism 600 are disposed inside the housing 100. The main switch 420 is electrically connected to the control board 410 for controlling power on/off, the electric motor 500 is electrically connected to the control board 500 to drive, via the transmission mechanism 600, the push rod 310 to move forward or rearward. The electric glue gun further comprises a sensor switch for facilitating control of a forward/rearward movement stroke of the push rod 310, and the sensor switch is electrically connected to the control board 410, such that the control board 410 determines whether the push rod 310 is moved to a limit position based on information feedback from the sensor switch.

In this embodiment, the housing 100 comprises a left housing 110 and a right housing 120 which are fixedly connected together, and the electric motor 500 is provided at the rear portion inside the housing 100. To effectively switch on or off the main switch 420, a trigger 430 corresponding to the main switch 420 is provided on the housing 100. When the trigger 430 is pressed, the main switch 420 is turned on and the control board 410 is energized. When the trigger 430 is released, the main switch 420 is turned off.

The transmission mechanism 600 comprises a gear box 610 and a gear transmission mechanism disposed in the gear box 610. The gear box 610 comprises a box body 611 and a box cover 612. One side of the box body 611 is provided with an opening. The box cover 612 is connected to the opening side of the box body 611 for closing the box body 611, allowing the inside of the gear box to form a relatively independent cavity. A support portion 613 formed by forward extension is provided on the box body 611. A support hole extending in a front-rear direction through the support portion is provided in the support portion 613. A support sleeve 320 is fixed at the support hole. The push rod 310 is arranged to penetrate through the support sleeve 320. With the support sleeve 320, the push rod 310 is subjected to a certain limit, thereby enhancing stability of the push rod 310 when moving in the front-rear direction. A front end of the support portion 613 is provided with a lap of ring-shaped groove 614. The front ends of the left and right housings 110, 120 are both provided with a semi-circular positioning convex edges 130 which are snapped into the ring-shaped groove 614. With the cooperation between the positioning convex edges 130 and the ring-shaped groove 614, the support portion 613 maintains fixed. The front end of the support portion 613 is connected with a hollow socket sleeve 330. The rear end of the glue tube holder 200 is fixedly connected with the socket sleeve 330 by thread-fitting. The rear end of the glue tube holder 200 is hollow, and the front end of the push rod 310 projects into the glue tube holder 200. To effectively extrude the glue tube, a push block 340 is fixed at the front end of the push rod 310, and the push block is disposed on the glue tube holder. To allow manual adjustment of the push rod when the gun body fails, a handle 350 is fixedly provided at the rear end of the push rod 310.

The gear transmission mechanism provided in the gear box 610 comprises a transmission gear 620, and the transmission gear 620 is rotatably disposed in the gear box 610. The sensor switch includes a first sensor switch corresponding to the teeth on the transmission gear 620, and the first sensor switch is configured for detecting the rearward movement stroke of the push rod 310. In this embodiment, the first sensor switch preferably adopts an optoelectronic switch 740, and the optoelectronic switch 740 is fixed on the gear box 610 and electrically connected to the control board 410. The optoelectronic switch 740 comprises an emitting end 741 and a receiving end 742, and the emitting end 741 and the receiving end 742 are respectively disposed at two axial sides of the transmission gear 620 and are arranged in mutual correspondence. A through-hole 615 for avoidance is provided on the box body 611 and the box cover 612. When the transmission gear 620 rotates till the teeth are located between the emitting end 742 and the receiving end 742, the receiving end cannot receive the signals emitted by the emitting end due to obstruction by the teeth. Therefore, the control board 410 determines the specific rearward movement stroke of the push rod 310 based on the number of times of the failure of receiving the signals fed back by the optoelectronic switch 740.

The transmission mechanism 600 drives, via toothed engagement, the push rod 310 to move forward or rearward. A plurality of transmission teeth 311 arranged in the front-rear direction are provided in the bottom part of the push rod 310. The gear transmission mechanism further comprises a three-pole planetary gear structure (not shown), a transmission shaft 630 and an output gear 640. The transmission shaft 630 is rotatably disposed in the gear box 610. The transmission gear 620 and the output gear 640 are sleeved on the transmission shaft 630. The teeth on the output wheel 640 are engaged with the transmission teeth 311 at the bottom portion of the push rod 310. The three-pole planetary gear structure is disposed between the motor shaft of the electric motor 500 and the output gear 640. When the electric motor 500 operates, the motor shaft drives the transmission gear 620 to rotate via the three-pole planetary gear structure, the transmission gear 620 then drives the output gear 640 to rotate via the transmission shaft 630, and the output gear 640 further drives the push rod 310 to move forward or rearward via toothed engagement. In this embodiment, the output gear 640 and the transmission gear 620 are preferably arranged into an integral structure. The transmission ratio between the output gear 640 and the transmission gear 620 is preferably set to 3:1.

To effectively control the forward movement stroke of the push rod 310, a sensing element is provided at a rear end of the push rod 310, the sensor switch comprising a second sensor switch corresponding to the sensing element. When the push rod 310 moves forward till the sensing element corresponds to the second sensor switch, the forward movement of the push rod 310 is in position. Then, the control board 410 may promptly cut off the current in the electric motor 500 based on the information feedback from the second sensor switch to stop the push rod 310 from forward movement.

In this embodiment, the sensing element adopts a magnet 710 and the second sensor switch adopts a magnetic sensor switch 720. A recessed hole for receiving the magnet 710 is provided at the top side of the rear end of the push rod 310. The magnet 710 is fixed in the recessed hole. Because the maximum stroke of forward movement of the push rod 310 differs somewhat dependent on whether a glue tube is installed on the glue tube holder, two magnetic sensor switches 720 are spaced apart from each other in the front-rear direction, including a first magnetic sensor switch 721 disposed at the rear and a second magnetic sensor switch 722 disposed in the front. To facilitate installation, two magnetic sensor switches are integrally arranged on one substrate 730. The substrate 730 is disposed above the push rod 310 and electrically connected to the control board 410. To install the substrate 730, a boss 140 integrally formed with the housing 100 is provided on the inner wall of the housing 100. A snap groove 141 for the edge of the substrate 730 to be snapped into is provided on the boss 140. The substrate 730 is fixed in the housing 100 by fitting with the snap groove 141.

When the gun body is in an operating state, i.e., the glue tube is installed on the glue tube holder 200, as the glue tube itself has a certain thickness in the front-rear direction, the push rod 310 moves forward till the magnet 710 is vertically aligned with the first magnetic sensor switch 721. At this time, the push rod 310 reaches the first limit position. When the gun body is in a non-operating state, i.e., the glue tube is not installed on the glue tube holder 200, since there is no obstruction by the glue tube, the forward movement stroke of the push rod 310 increases a little. Due to causes such as manual operation, when the push rod 310 moves forward till the magnet 710 is vertically aligned with the second magnetic sensor switch 722, the push rod 310 moves forward till the second limit position.

When the gun body is in an operating state, i.e., when the glue tube is installed on the glue tube holder 200, by pressing the trigger 430, the main switch 420 is turned on, the control board 410 is energized to supply power to the electric motor 500. The electric motor 500 is energized to rotate clockwise, and the motor shaft drives, via the transmission mechanism 600, the push rod 310 to move forward. When the push rod 310 moves forward till the magnet 710 vertically corresponds to the first magnetic sensor switch 721, the control board 410 determines, based on the signal feedback from the first magnetic sensor switch 721, that the push rod 310 reaches the first limit position. If the trigger 430 is continued to be pressed, the control board 410 supplies power reversely to the electric motor 500. Then, the electric motor 500 rotates reversely, and the motor shaft drives the push rod 310 to move rearward via the transmission mechanism 600. During the process of rearward movement of the push rod 310, the optoelectronic switch 740 feeds back a signal to the control board 410 under the obstruction of the teeth on the transmission gear 620. When the number of times of the optoelectronic switch 740 is obstructed by the teeth reaches N1, the control board 410 determines, based on the signal fed back from the optoelectronic switch 740, that the push rod 310 is moved rearward to the first limit position, the control board 410 suspends power supply to the electric motor. Then, the electric motor 500 stops rotating, and the push rod 310 stops rearward movement. If the maximum number of times of the engagement between the transmission teeth 311 and the output gear 640 during the front-to-rear movement of push rod 310 reaches 60 times, as the transmission ratio between the output gear 640 and the transmission gear 620 is set to 3:1, N1 should be 180 times.

The gun body is in a non-operating state, i.e., the glue tube is not installed on the glue tube holder 200. When the push rod moves forward till the magnet is vertically aligned with the second magnetic sensor switch 722, the push rod 310 reaches the second limit position. At this point, the trigger 430 is pressed, and the control board 410 determines, based on the signal feedback from the second magnetic sensor switch 722, that the push rod 310 reaches the second limit position. If the trigger 430 is continued to be pressed, the control board 410 supplies power reversely to the electric motor 500. Then, the electric motor 500 rotates reversely, and the motor shaft drives the push rod 310 to move rearward via the transmission mechanism 600. During the process of rearward movement of the push rod 310, the optoelectronic switch 740 feeds back a signal to the control board 410 under the obstruction of the teeth on the transmission gear 620. When the number of times of the optoelectronic switch 740 being obstructed by the teeth reaches N2, the control board 410 determines, based on the signal feedback from the optoelectronic switch 740, that the push rod 310 is moved rearward to the second limit position. The control board then suspends power supply to the electric motor. The electric motor 500 stops rotating, and the push rod 310 stops rearward movement. If the interval between the first magnetic sensor switch 721 and the second magnetic sensor switch 722 corresponds to a distance of three transmission teeth 311 and the maximum number of times of the engagement between the transmission teeth 311 and the output gear 640 during the front-to-rear movement of push rod 310 reaches 63 times, as the transmission ratio between the output gear 640 and the transmission gear 620 is set to 3:1, N2 should be 183 times.

If the trigger 430 in the operating state is released and the push rod 310 does not reach the first limit position, in order to prevent glue dripping, the control board 410 supplies power reversely to the electric motor after the trigger 430 is released, then the electric motor 500 rotates reversely, and the motor shaft drives the push rod 310 to move rearward a certain distance via the transmission mechanism 600. Supposing the rearward movement distance of the push rod 310 to prevent glue dripping is the length of one transmission tooth 311, because the transmission ratio between the output gear 640 and the transmission gear 620 is 3:1, then the number of teeth traversed by reverse rotation of the transmission gear 620 should be three, i.e., the optoelectronic switch 740 is blocked thrice by the teeth of the transmission gear 620. The control board 410 determines, based on the signal feedback from the optoelectronic switch 740, whether the push rod 310 is moved rearward to an appropriate position. When the optoelectronic switch 740 is obstructed thrice by the teeth of the transmission gear 620, the push rod 310 moves rearward till the appropriate position, the control board then suspends power supply, the electric motor 500 stops rotating, and the push rod 310 stops rearward movement.

It may be understood that the specific mount position of the substrate 730 is not limited to the above disclosure or the drawings, and other reasonable fixation and mount structures may also be adopted, e.g., screw fixation.

It may be understood that the fitting between the sensing element and the first sensor switch is not limited to the above fitting between the magnet 710 and the magnetic sensor switch 720, and other reasonable fitting members may also be employed.

It may be understood that the second sensor switch is not limited to the optoelectronic switch 740 disclosed above or illustrated in the drawings, and other sensor switches capable of detecting the number of teeth traversed by rotation of the transmission gear 620 may also be employed.

It may be understood that the output gear 640 and the transmission gear 620 may also adopt a separate structure, i.e., the output gear and the transmission gear are separately formed and respectively fixedly sleeved on the transmission shaft 630.

It may be understood that the transmission ratio between the output gear 640 and the transmission gear 620 may also adopt another appropriate transmission ratio. The maximum number of times of the engagement between the transmission gear 311 and the output gear 640 when the push rod 310 moves from front to rear may also be set to another reasonable number of times based on the specific length of the push rod. Correspondingly, the specific values of N1 and N2 are determined reasonably based on the maximum number of times of the engagement with the output gear when the push rod moves as well as the transmission ratio between the output gear 640 and the transmission gear 620.

Besides the preferred embodiments above, the present disclosure also has other embodiments. Those skilled in the art may make various variations and alternations based on the present disclosure, and such variations and alterations should fall within the scope defined by the appended claims without departing from the spirit of the present disclosure.

What is claimed is:

1. An electric glue gun, comprising a housing, a glue tube holder arranged at a front end of the housing, and a push rod disposed on the housing and moveable forward and rearward relative to the glue tube holder, wherein a control board, a main switch, an electric motor and a transmission mechanism are provided inside the housing, the main switch is electrically connected to the control board for controlling power on/off, the electric motor is electrically connected to the control board to drive the push rod to move forward or rearward via the transmission mechanism; and the electric glue gun further comprising a sensor for facilitating control of a forward movement stroke and a rearward movement stroke of the push rod, the sensor is electrically connected to the control board, such that the control board determines whether the push rod is moved to a limit position based on information feedback from the sensor, wherein the transmission mechanism comprises a transmission gear, and the sensor comprises a first sensor corresponding to teeth on the transmission gear for detecting the rearward movement stroke of the push rod, a sensed element is provided at a rear end of the push rod, and the sensor comprises a second sensor corresponding to the sensed element for feeding back the forward movement stroke of the push rod, the second sensor includes two second sensors, the two second sensors are spaced apart from each other in a front-rear direction; in an operating state, the push rod is moved forward to a first limit position corresponding to a rear one of the second sensors; when in a non-operating state, the push rod is moved forward to a second limit position corresponding to a front one of the second sensors.

2. The electric glue gun according to claim 1, wherein the first sensor is an optoelectronic switch including an emitting end and a receiving end, and the emitting end and the receiving end are respectively arranged at two axially opposite sides of the transmission gear and disposed in mutual correspondence.

3. The electric glue gun according to claim 2, wherein a trigger corresponding to the main switch is provided on the housing; the main switch is turned on when the trigger is pressed, and the main switch is turned off when the trigger is released; and/or, a push block is provided at a front end of the push rod.

4. The electric glue gun according to claim 1, wherein the transmission mechanism comprises a gear box, the transmission gear is rotatably disposed inside the gear box, the first sensor is provided on the gear box, and the gear box is formed with a through-hole corresponding to the first sensor.

5. The electric glue gun according to claim 4, wherein the transmission mechanism comprises a transmission shaft and an output gear which are provided in the gear box, the output gear and the transmission gear are both sleeved on the transmission shaft, transmission teeth are arranged in a bottom part of the push rod, and the transmission teeth are engaged with teeth of the output gear; and/or, a support portion is provided at a front end of the gear box, a support hole is provided in the support portion, a support sleeve is provided at the support hole, and the push rod is disposed to penetrate through the support sleeve.

6. The electric glue gun according to claim 5, wherein a trigger corresponding to the main switch is provided on the housing; the main switch is turned on when the trigger is pressed, and the main switch is turned off when the trigger is released; and/or, a push block is provided at a front end of the push rod.

7. The electric glue gun according to claim 4, wherein a trigger corresponding to the main switch is provided on the housing; the main switch is turned on when the trigger is pressed, and the main switch is turned off when the trigger is released; and/or, a push block is provided at a front end of the push rod.

8. The electric glue gun according to claim 1, wherein the sensed element is a magnet, and the two second sensors are magnetic sensors.

9. The electric glue gun according to claim 8, wherein a trigger corresponding to the main switch is provided on the housing; the main switch is turned on when the trigger is pressed, and the main switch is turned off when the trigger is released; and/or, a push block is provided at a front end of the push rod.

10. The electric glue gun according to claim 1, wherein the sensed element is disposed at a top side of the rear end of the push rod, and the two second sensors are provided above the sensed element; and/or snap grooves respectively matched with the two second sensor are provided on an inner wall of the housing, and the two second sensors are disposed inside the housing by fitting with the snap grooves.

11. The electric glue gun according to claim 10, wherein a trigger corresponding to the main switch is provided on the housing; the main switch is turned on when the trigger is pressed, and the main switch is turned off when the trigger is released; and/or, a push block is provided at a front end of the push rod.

12. The electric glue gun according to claim 1, wherein a trigger corresponding to the main switch is provided on the housing; the main switch is turned on when the trigger is pressed, and the main switch is turned off when the trigger is released; and/or, a push block is provided at a front end of the push rod.

* * * * *